US009296602B2

(12) United States Patent
Juhasz

(10) Patent No.: US 9,296,602 B2
(45) Date of Patent: Mar. 29, 2016

(54) VEHICLE FUEL DISPENSING SYSTEM FOR DWELLINGS

(71) Applicant: Paul R. Juhasz, Houston, TX (US)

(72) Inventor: Paul R. Juhasz, Houston, TX (US)

( * ) Notice: Subject to any disclaimer, the term of this patent is extended or adjusted under 35 U.S.C. 154(b) by 149 days.

(21) Appl. No.: 13/759,031

(22) Filed: Feb. 4, 2013

(65) Prior Publication Data

US 2014/0216596 A1 Aug. 7, 2014

Related U.S. Application Data

(60) Provisional application No. 61/595,936, filed on Feb. 7, 2012.

(51) Int. Cl.

| | |
|---|---|
| ***B65B 37/00*** | (2006.01) |
| ***B67D 7/16*** | (2010.01) |
| ***B67D 7/78*** | (2010.01) |

(52) U.S. Cl.
CPC ... *B67D 7/16* (2013.01); *B67D 7/78* (2013.01)

(58) Field of Classification Search
CPC ..... B67D 7/04; F17C 2265/065
USPC ..... 141/99, 206, 236, 242, 302
See application file for complete search history.

(56) References Cited

U.S. PATENT DOCUMENTS

| | | | | |
|---|---|---|---|---|
| 3,926,230 | A * | 12/1975 | Stary et al. | 141/45 |
| RE35,238 | E * | 5/1996 | Pope | 141/59 |
| 5,908,141 | A * | 6/1999 | Teel | 222/3 |
| 6,131,621 | A * | 10/2000 | Garrard | 141/59 |
| 7,011,118 | B2 * | 3/2006 | Chan et al. | 141/98 |
| 2002/0029820 | A1 * | 3/2002 | Ovshinsky et al. | 141/110 |
| 2003/0205287 | A1 * | 11/2003 | Sobota et al. | 141/59 |
| 2014/0130938 | A1 * | 5/2014 | Luparello | 141/69 |

* cited by examiner

*Primary Examiner* — Jason K Niesz
(74) *Attorney, Agent, or Firm* — The Juhasz Law Firm

(57) ABSTRACT

Vehicle fuel dispensing system for a dwelling unit includes a fuel source and a fuel supply conduit for the unit connected to the fuel source. The fuel supply conduit has an in-line meter for measuring fuel flow characteristics and provides readouts of the characteristics. Vehicle fuel dispensing system for a plurality of dwelling units includes a fuel source and a fuel supply conduit for the plurality of units connected to the fuel source. The fuel supply conduit has an in-line meter for measuring fuel flow characteristics and provides readouts of the characteristics. Method of dispensing vehicle fuel to one or more dwelling units includes steps of: providing a fuel source; providing a fuel supply conduit for the one or more units for connecting the fuel source to the one or more units; and providing an in-line meter for measuring fuel flow characteristics and providing readouts of the characteristics.

20 Claims, 5 Drawing Sheets

VEHICLE FUEL DISPENSING SYSTEM FOR DWELLINGS

TECHNICAL FIELD

This disclosure is directed to gasoline, diesel and other fuels for vehicles and more specifically to the delivery of such fuels to consumers for use in combustion engines used in transportation.

BACKGROUND

Gasoline, diesel, and other fuels for vehicles are important to our economy. They provide the fuel that is used in combustion engines that enables many forms of modern transportation.

Gasoline is delivered to consumers through a fuel dispensing station, otherwise known as a gas station. When gas is needed, a consumer drives his car to the gas station and uses one of the pumps to fill his car with gas. The fuel that is dispensed at a gas station may be delivered to the gas station by tanker trucks. These tanker trucks may be filled with the fuel at a distribution center where storage tanks may store the fuel that is delivered from refineries. The fuel that is delivered to the distribution centers may come from a refinery by way of pipeline or ship. While this example is illustratively directed to gasoline, the filling station may also pump diesel, ethanol fuels, biofuels, or other types of fuel into vehicles.

Gas stations have been around for a long time as an accepted part of our economy. Their success has been based in part on their ability to adapt to the changes placed upon them by the modern economy. For example, in geographies experiencing population growth, the gas industry has responded by opening up new gas stations to service the growing population. As another example, when gas stations have been challenged by the environmentalists, the gas industry has responded by designing gas stations that are more environmentally friendly and aesthetic.

Still, as population continues to grow and the balance that exists between gas stations and the environment grows more tense, there is a need for an improved system and method for dispensing fuel that relaxes that tension. One that will reduce the glut of gas stations, reduce the queau time for consumers at fuel dispensing machines, bring fuel dispensing more into harmony with the environment, and provide an overall more efficient and environmentally friendly solution. This disclosure addresses that need.

SUMMARY OF THE INVENTION

A vehicle fuel dispensing system for a dwelling unit includes a fuel source and a fuel supply conduit for the unit connected to the fuel source. The fuel supply conduit has an in-line meter for measuring fuel flow characteristics therethrough and for providing readouts of the characteristics.

A vehicle fuel dispensing system for a plurality of dwelling units includes a fuel source and a fuel supply conduit for the plurality of units connected to the fuel source. The fuel supply conduit has an in-line meter for measuring fuel flow characteristics therethrough and for providing readouts of the characteristics.

A method of dispensing vehicle fuel one or more dwelling units includes the steps of providing a fuel source; providing a fuel supply conduit for the one or more units for connecting the fuel source to the one or more units; providing an in-line meter for measuring fuel flow characteristics therethrough; and providing readouts of said characteristics.

DETAILED DESCRIPTION

Figure 1:
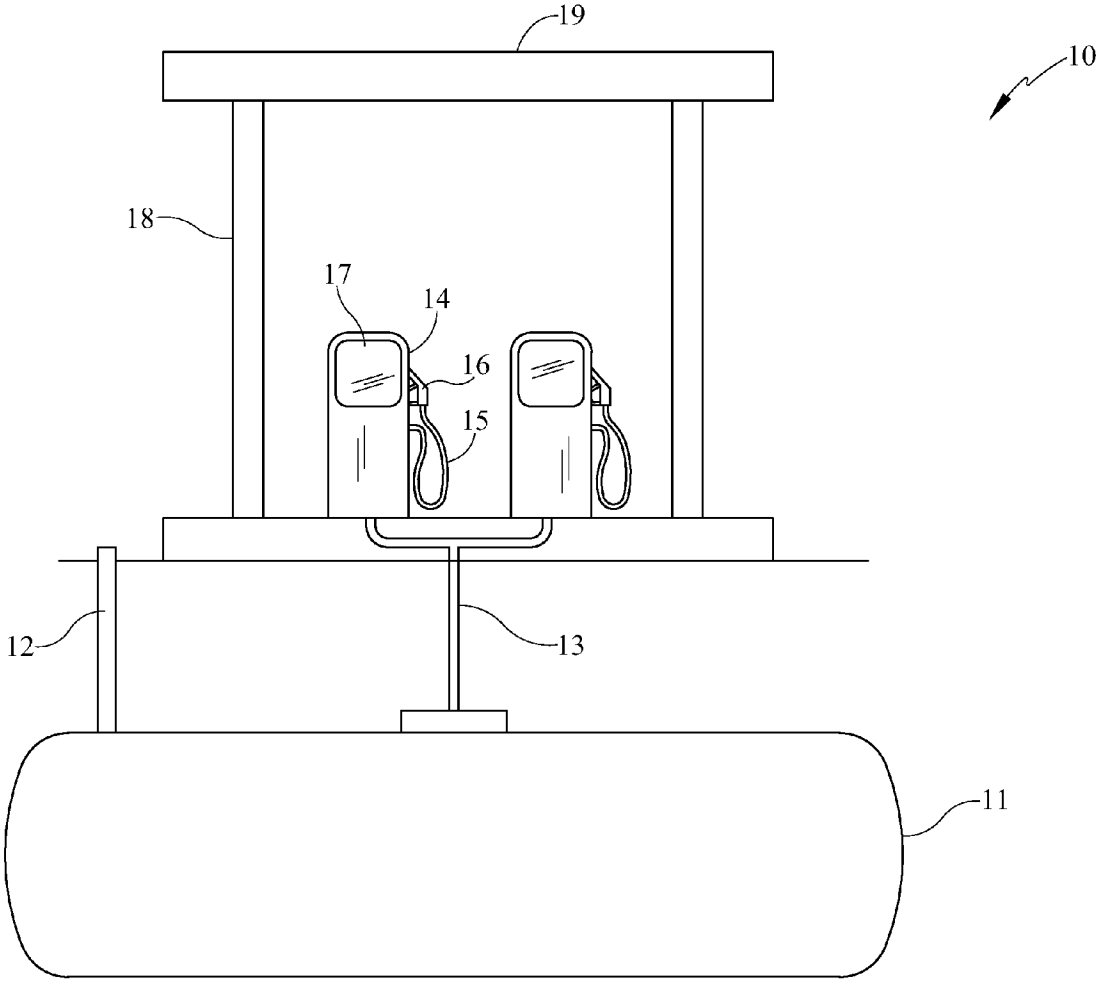
FIG. 1 is a sectional side view of a dispensing station of the prior art.

FIG. 1 shows an illustrative example of a fuel dispensing system 10 according to the prior art. Fuel dispensing system 10 comprises a fuel tank 11, a fill line 12, a flow line 13, a pump 14, and a roof 19. Fuel tank 11 is filled with fuel, such as gas, diesel, a biofuel, or other type of fuel for vehicles through fuel line 12 in a manner well known in the art. Pump 14 draws fuel in fuel tank 11 through flow line 13 into a dispensing line 15 having a nozzle 16. Roof 19 shields the pump and a consumer from the weather. In use, a consumer typically parks his car next to pump 14 so that the opening of the gas tank of his car is directed toward the pump. The consumer typically pays in advance by credit card or cash if required, selects which grade of fuel to use for his car, places the nozzle 16 into the opening of the gas tank of his car, and activates the nozzle to cause fuel to be pumped through the fuel line into his gas tank. A readout 17 may display the number of gallons of gas that has been pumped and the price of the sale.

Figure 2:
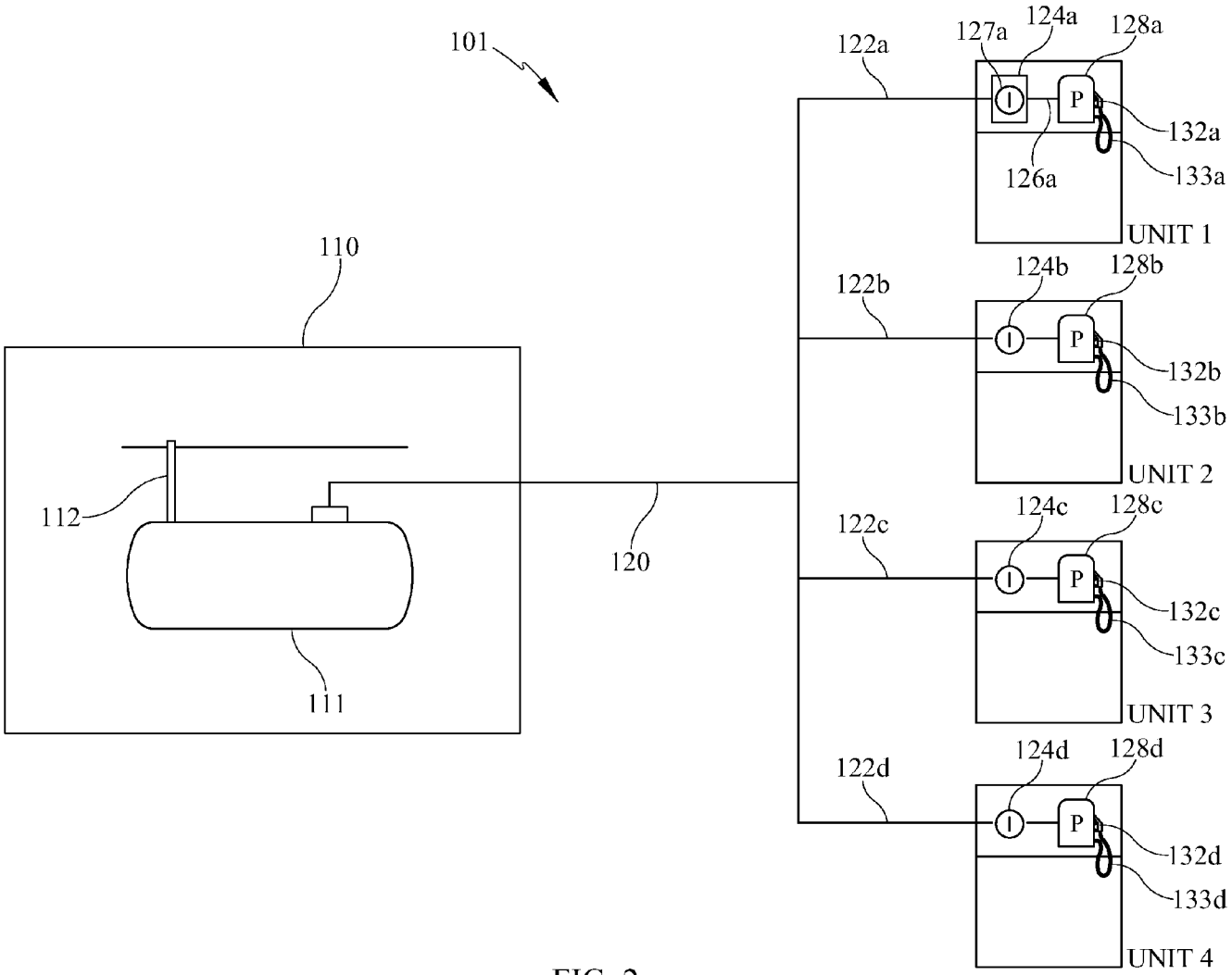
FIG. 2 is a schematic diagram of a fuel dispensing system and method in accordance with the present disclosure.

FIG. 2 shows an illustrative fuel dispensing system 101 for a plurality of dwelling units (Units 1-4) in accordance with this disclosure. The system 101 illustratively comprises: a fuel source 110, a fuel feeder pipeline 120, and a fuel supply conduit 122(*a-d*) for each unit connected to said fuel source. Each fuel supply conduit has an in-line meter 124(*a-d*); a pump 128(*a-d*), and a dispensing line 133(*a-d*) having a nozzle 132(*a-d*).

Illustratively, fuel source 110 is a fuel tank located near the plurality of dwelling units. Alternatively, fuel source 110 may be a remotely located distribution station and a longer feeder pipeline 120 used to deliver the fuel from the distribution station to fuel supply conduits 122(*a-d*). Where feeder pipe line 120 travels a longer distance, pump stations (not shown) may be used along the pipeline to aid in the movement of the fuel through the fuel supply conduit 122(*a-d*) to meet the usage demands of the one or more of the Units 1-4. Fuel tank 110 is filled with fuel through fuel line 112 in a manner well known in the art. In-line meter 124(*a-d*), pump(*a-d*), dispensing line 133(*a-d*), and nozzle 132(*a-d*) are components known in the art that may be scaled for the application and use taught by this disclosure.

Illustratively, pump 128(*a-d*) and dispensing line 133(*a-d*) are located in or about a garage of the Units 1-4. The location of choice should provide for adequate ventilation for when the fuel is pumped into a vehicle. If located inside a garage or a closed space associated with each of Units 1-4, a fan or other air flow circulation system may be provided to ensure adequate ventilation of gas or other fumes that may develop in the area on account of the system. Alternatively, the pump can be located outside the Units 1-4 open to the outside air in a location that is adequately ventilated by the outside air and is accessible by a a vehicle for fueling. In yet another illustrative example, some of the pumps may be located inside the garage or closed space associated with Units 1-4 while the remaining pumps may be located outside open to the air.

Figure 6:
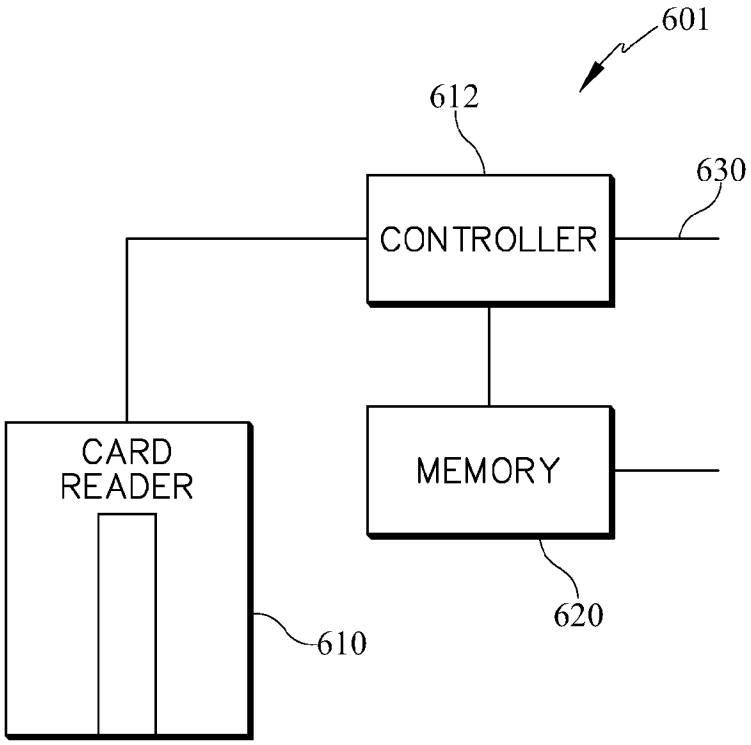
FIGS. 5 and 6 show two illustrative safety lock down features for use with the system of the present disclosure.
Figure 5:
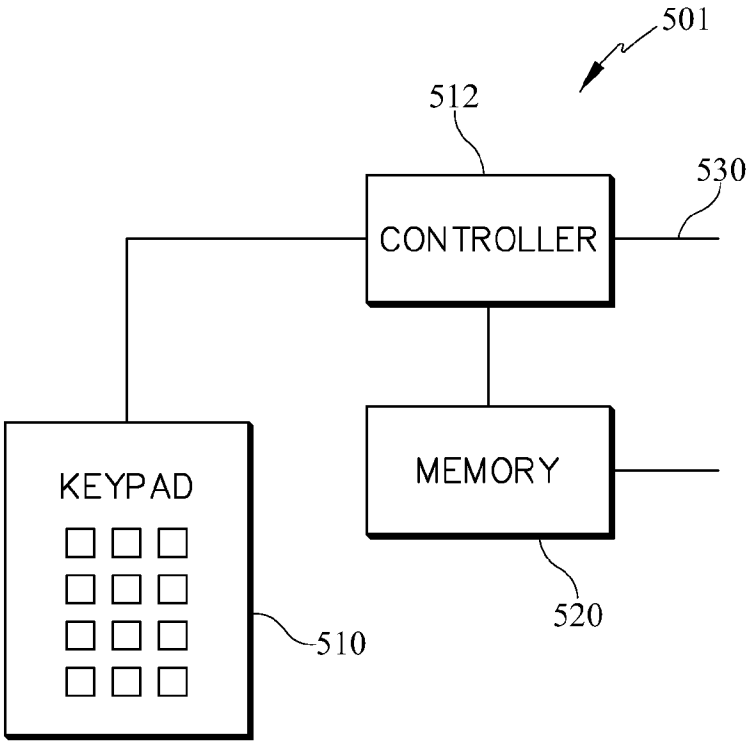

Illustratively, the pump may be provided with a security lock down feature to ensure that the pump is only used by persons authorized to use that pump. This serves to protect the pump from being used by children that may be playing in the area. It also ensures that the user of the fuel is the owner of the unit or has been authorized by the user to use the pump; and not an unauthorized user such as a thief. As shown in FIG. 5, security lock down feature 501 may illustratively include an electronic controller 512 with an electronic keypad 510 for data entry. Illustratively, a consumer manually enters his password using keypad 510 which the controller compares to the password stored in a memory 520. On a match between manually entered and stored passwords, controller 512 generates a signal on line 530 that enables the pump for use. FIG. 6 shows a security lock down feature 601 comprising a card reader 610, controller 612, and memory 620. Lock-down feature 601 operates in a similar way than lock down feature 501 except that the password that is entered into the controller is read the cardreader instead of entered manually as is done in lock down feature 501.

Referring again to FIG. 2, pump 128(*a-d*) draws fuel from fuel tank 110 through fuel supply conduit 122(*a-d*) from flow line 120 through meter 127(*a-d*) under the action of pump 128(*a-d*), respectively, into dispensing line 133(*a-d*), respectively. Pump 128(*a-d*) is activated on depressing a handle (not shown) on nozzle 132(*a-d*), respectively, in a manner well known in the art. Each unit in the plurality of dwellings is illustratively provided with like flow supply conduit 122, pump 128, and dispensing line 133 having like nozzle 132 for pumping on activation of the nozzle and preferably works independently. Alternatively, such pump system may be provided to some but not all units of the plurality of dwellings.

In-line meter 124(*a-d*) illustratively measures fuel flow characteristics through fuel supply conduit 122(*a-d*). The in-line meter is enabled to providing readouts of the characteristics of the fuel that is flowing through the meter. The characteristics of the fuel that may be read out are well known in the art such as fluid flow. Illustratively, the read-out may be electrically communicated to a monitoring station (not shown) where the use of the gas at each pump in the system may be monitored. Alternatively, the read-out may be a visible read-out such as by digital or analog display which lends itself to meter reading by a provider of the fuel.

In use, one or more units in the system provided with flow supply conduit 122, pump 128, and dispensing line 133 having nozzle 132 for pumping on activation of the nozzle that may be useable at the convenience of the unit consumer or consumer authorized by the unit consumer. The system allows for accessibility to gas by a unit consumer or consumers authorized by the unit consumer without going to a gas station. This allows for a replacement of traditional gas stations with an on-site fuel service that is delivered and monitored like a utility. Alternatively, the disclosed system provides a system for dispensing fuel that may provide dispensing of gas additional to gas stations. In either illustrative case, the system provides an alternative fuel delivery platform to gas stations and may be economically more friendly. The on-site delivery system allows a unit consumer or consumers authorized by the unit consumer to pump fuel any time without having to go to a gas station and waiting in a queue. More efficient fuel delivery may be a result.

Figure 3:
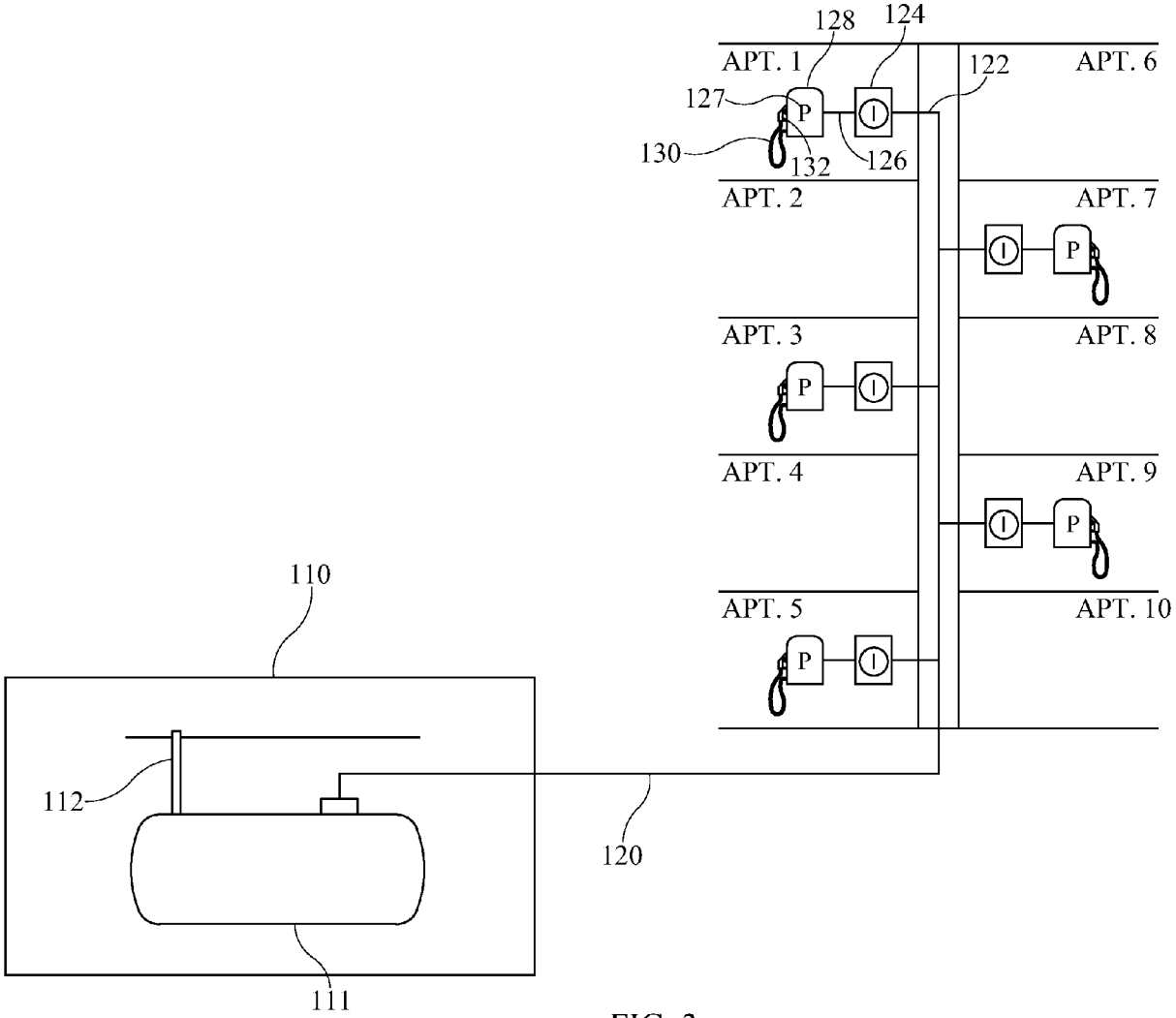
FIG. 3 is another illustrative system and method in accordance with the present disclosure.

FIG. 3 shows an illustrative fuel dispensing system 101 for a high rise building (8 apartments in this example) in accordance with this disclosure. The system 101 is similar to the like system in FIG. 2 and the elements in FIG. 3 bear the same numbers as like elements in FIG. 2 and operate in a like manner. In this example, the pump and dispensing line are located in a parking area at or near the parking space provided for each of apartments 1, 3, 6, 7, and 9. Alternatively, the pump and dispensing lines may be located in the parking area for each of the apartments in the building. The location of choice for the pump and dispensing line should provide adequate ventilation of gas or other fumes that may develop in the area on account of the system and its use. Illustratively, a security feature such as an electronic security entry pad as previously discussed may be used in order to ensure that the user of the pump is authorized to use the pump. Alternatively, one or more pumps may be shared between a plurality of tenants in the building. For example, the pump that is shown in FIG. 3 to reside for parking space for Apartment 9 may be located to service parking spaces for both Apartments 9 and 10. Alternative, a pump may be located removed from the parking individual parking slips but preferably in general proximity to so that one pump may be used by all of the apartments in the building. In cases involving a pump for servicing more than one user, and with reference to FIGS. 5 and 6, the security feature 501, 601 on such a pump may be programmed in memory 520, 620, respectively with passwords of the multiple users authorized to use this pump. On matching of a password input by either authorized user via keyboard 510 or card reader 610, with the authorized passwords stored in memory 520, 620, respectively, controller 512, 612, respectively, controller 512, 612, enables the pump to be used by the person who has entered the authorized password.

Figure 4:
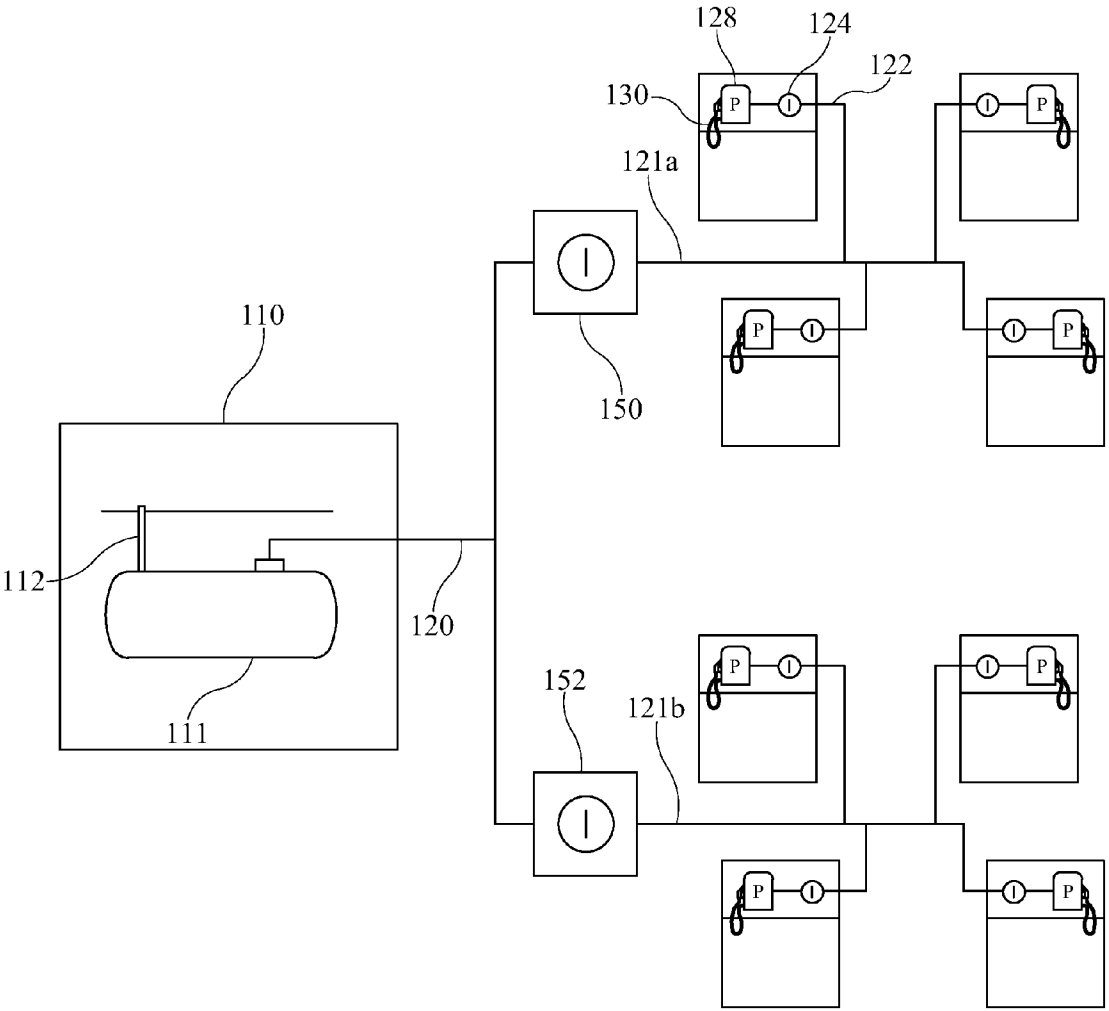
FIG. 4 is another illustrative system and method in accordance with the present disclosure.

FIG. 4 shows an illustrative fuel dispensing system 101 for a residential homes (8 homes) in accordance with this disclosure. The system 101 is similar to the like system in FIG. 2 and the elements in FIG. 4 bear the same numbers as like elements in FIG. 2 and operate in a like manner. FIG. 4 shows feeder pipe line 120 breaking into two artery feeder pipe lines 121*a*, 121*b*, and a main meters 150, 152 provided for each for the purpose of providing readouts of the characteristics of the fuel that is flowing from the main meter to the artery feeder pipe lines. This allows a service provider to provide the fuel services to be provided efficiently to different grids of homes or apartment units within a system.

INDUSTRIAL APPLICABILITY

The industrial applicability of the system and method are evident from the disclosure above. Individual units in a dwelling may be provided with pump 128 to allow consumers dwelling in the unit to draw fuel from a fuel tank 110 through a flow line 120 through dispensing line 133 and nozzle 132 into a fuel tank of a vehicle at the dwelling. When the dwelling consumer activates pump 128 by depressing a handle (not shown), fuel from fuel supply conduit passes through dispensing line 133 and nozzle 132 into the tank of of the vehicle of the unit consumer without the consumer having to go to a gas station to fuel his car. His fuel use is monitored by the meter.

The method of dispensing fuel for one or more dwelling units illustratively involve providing a fuel source; providing a fuel supply conduit for the one or more units for connecting the fuel source to the one or more units; providing an in-line meter for measuring fuel flow characteristics therethrough and providing readouts of said characteristics.

By providing individual units in the system with a pump that may be useable at the convenience of the dwelling unit consumer, the system allows the fuel delivery system to be utilized like water or electricity. The consumer dweller of the unit or authorized by the dweller of the unit uses the fuel dispensing system when he has the need for fuel and is billed for the use. This allows for accessibility to gas by a dwelling consumer without having to go to a gas station. This allows for an alternative form of delivering gas to dwelling consumers to traditional gas stations that may be provided as an on-site fuel service that may be delivered and monitored like electricity, water, or other utility by commercial companies or by a public utility. The system provides an alternative fuel delivery platform to the expansion of gas stations that may be economically more friendly. Alternatively, the utilizing of the distribution of vehicle fuel in accordance with this disclosure may supplement the traditional gas stations to relieve the congestion at traditional gas stations and provide for a more balanced economically friendly vehicle dispensation system. The on-site delivery system allows a dwelling consumer or person authorized by the dwelling consumer to pump fuel any time without having to go to a gas station and waiting in a queue. More efficient fuel delivery may be a result.

What is claimed is:

1. A vehicle fuel dispensing system comprising:

a grid of homes, apartment buildings, or a combination thereof;

a fuel source and a feeder pipeline configured for supplying fuel to the grid of homes, apartment buildings, or a combination thereof;

a fuel dispensing line connected to a fuel supply conduit connected to the feeder pipeline; and a nozzle connected to the fuel dispensing line, wherein the fuel dispensing line and the nozzle are located at or in proximity to at least one home or apartment building within the grid of homes, apartment buildings, or a combination thereof, the nozzle being configured for dispensing fuel into a fuel tank of a vehicle at the at least one home or apartment building within the grid of homes, apartment buildings, or a combination thereof, wherein the fuel is supplied to the grid of homes, apartment buildings, or a combination thereof as a metered utility; and wherein said fuel is taken from the group consisting of gasoline, diesel, and biofuel.

2. The fuel dispensing system of claim 1 wherein the at least one home or apartment building within the grid of homes, apartment buildings, or a combination thereof is a high rise.

3. The fuel dispensing system of claim 1 further comprising:

a meter for measuring flow of fuel through the fuel supply conduit; and a monitoring station configured for monitoring the measured fuel flow.

4. The fuel dispensing system of claim 3 wherein the at least one home or apartment building within the grid of homes, apartment buildings, or a combination thereof is a high rise.

5. The fuel dispensing system of claim 1 wherein the grid of homes, apartment buildings, or a combination thereof defines a first grid of homes, apartment buildings, or a combination thereof;

wherein the fuel source and the feeder pipeline configured for supplying fuel to the grid of homes, apartment buildings, or a combination thereof defines a first fuel source and a first feeder pipeline;

wherein the fuel dispensing line defines a first fuel dispensing line;

wherein the nozzle connected to the first fuel dispensing line defines a first nozzle;

the system further comprising a second grid of homes, apartment buildings, or a combination thereof, the first fuel source being further configured for supplying fuel to the second grid of homes, apartment buildings, or a combination thereof;

a second fuel dispensing line connected to a second fuel supply conduit connected to a second feeder pipeline; and a second nozzle connected to the second fuel dispensing line;

the second fuel dispensing line and the second nozzle located at or in proximity to at least one home or apartment building within the second grid of homes, apartment buildings, or a combination thereof;

the second nozzle being configured for dispensing fuel into a fuel tank of a vehicle at the at least one home or apartment building within the second grid of homes, apartment buildings, or a combination thereof;

wherein the supplied fuel is supplied to the second grid of homes, apartment buildings, or a combination thereof as a metered utility.

6. The fuel dispensing system of claim 1 further comprising:

a meter for measuring flow of fuel through the feeder pipeline; and a monitoring station configured for monitoring the measured fuel flow.

7. The fuel dispensing system of claim 1 further comprising:

a meter for measuring flow of fuel through the fuel dispensing line; and a monitoring station configured for monitoring the measured fuel flow.

8. The fuel dispensing system of claim 5 further comprising:

a meter for measuring flow of fuel through the fuel supply conduit; and a monitoring station configured for monitoring the measured fuel flow.

9. A method of monitoring user consumption of vehicle fuel comprising the steps of:

defining a grid of homes, apartment buildings, or a combination thereof;

providing a source of fuel for the grid of homes, apartment buildings, or a combination thereof; and dispensing fuel via a fuel dispensing system to at least one home or apartment building within the grid of homes, apartment buildings, or a combination thereof;

wherein the fuel dispensing system is configured for dispensing into at least one vehicle as a metered utility; and wherein the fuel is taken from the group consisting of gasoline, diesel, and biofuel.

10. The method of claim 9 further comprising the step of:

measuring a flow of fluid fuel dispensed to the at least one home or apartment building within the grid of homes, apartment buildings, or a combination thereof.

11. The method of claim 9:

wherein the grid of homes, apartment buildings, or a combination thereof defines a first grid of homes, apartment buildings, or a combination thereof;

wherein the dispensing of fuel to at least one home or apartment building within the first grid of homes, apartment buildings, or a combination thereof defines a first dispensing fuel system; and further comprising the steps of:

defining a second grid of homes, apartment buildings, or a combination thereof;

providing a second source of fuel for the second grid of homes, apartment buildings, or a combination thereof;

dispensing fuel from the second source of fuel to at least one home or apartment building within the second grid of homes, apartment buildings, or a combination thereof;

wherein the dispensing is configured for dispensing into at least one vehicle as a metered utility; and wherein the dispensing of fuel to at least one home or apartment building within the second grid of homes, apartment buildings, or a combination thereof defines a second dispensing fuel system.

12. The method of claim 11:

wherein the first fuel source and the second source are configured as a single source of fuel.

13. The fuel dispensing system of claim 1 wherein the at least one home or apartment building within the grid of homes, apartment buildings, or a combination thereof is a home.

14. The fuel dispensing system of claim 5 further comprising:

a meter for measuring flow of fuel through the first fuel dispensing line; and a monitoring station configured for monitoring the measured fuel flow.

15. The fuel dispensing system of claim 1, wherein the grid of homes, apartment buildings, or a combination thereof defines a first grid of homes, apartment buildings, or a combination thereof;

wherein the fuel source and the feeder pipeline configured for supplying fuel to the grid of homes, apartment buildings, or a combination thereof defines a first fuel source and a first feeder pipeline;

wherein the fuel dispensing line defines a first fuel dispensing line;

wherein the nozzle connected to the first fuel dispensing line defines a first nozzle;

the system further comprising a second grid of homes, apartment buildings, or a combination thereof, a second fuel source being further configured for supplying fuel to the second grid of homes, apartment buildings, or a combination thereof;

a second fuel dispensing line connected to a second fuel supply conduit connected to a second feeder pipeline; and a second nozzle connected to the second fuel dispensing line;

the second fuel dispensing line and the second nozzle located at or in proximity to at least one home or apartment building within the second grid of homes, apartment buildings, or a combination thereof;

the second nozzle being configured for dispensing fuel into a fuel tank of a vehicle at the at least one home or apartment building within the second grid of homes, apartment buildings, or a combination thereof;

wherein the supplied fuel from each of the first fuel source and the second fuel source is supplied to the first and second grid of homes, apartment buildings, or a combination thereof, respectively, as a metered utility.

16. The fuel dispensing system of claim 15 further comprising:

a meter for measuring flow of fuel through the first fuel dispensing line; and a monitoring station configured for monitoring the measured fuel flow.

17. The fuel dispensing system of claim 15 further comprising:

a meter for measuring flow of fuel through the second fuel dispensing line; and a monitoring station configured for monitoring the measured fuel flow.

18. The fuel dispensing system of claim 1 further comprising a pump, the pump configured for pumping the fuel through the nozzle.

19. The fuel dispensing system of claim 18 further comprising a smart security device, the smart security device comprising a controller, a memory, and a user interface, the user interface configured for data entry by a user, the smart security device activating the pump for pumping the fuel upon a predetermined data entry by the user.

20. The fuel dispensing system of claim 19 wherein the user interface is taken from the group consisting of a keypad and a card reader.

* * * * *